US009978333B2

(12) United States Patent
Zhang et al.

(10) Patent No.: US 9,978,333 B2
(45) Date of Patent: May 22, 2018

(54) TIMING SEQUENCES GENERATION CIRCUITS AND LIQUID CRYSTAL DEVICES

(71) Applicant: Shenzhen China Star Optoelectronics Technology Co., Ltd., Shenzhen, Guangdong (CN)

(72) Inventors: Xianming Zhang, Guangdong (CN); Dan Cao, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 91 days.

(21) Appl. No.: 14/905,800

(22) PCT Filed: Jul. 31, 2015

(86) PCT No.: PCT/CN2015/085799
§ 371 (c)(1),
(2) Date: Jan. 16, 2016

(87) PCT Pub. No.: WO2017/012139
PCT Pub. Date: Jan. 26, 2017

(65) Prior Publication Data

US 2017/0162167 A1 Jun. 8, 2017

(30) Foreign Application Priority Data

Jul. 20, 2015 (CN) ..... 2015 1 0427038

(51) Int. Cl.
*G09G 3/36* (2006.01)

(52) U.S. Cl.
CPC ..... *G09G 3/3696* (2013.01); *G09G 3/3677* (2013.01); *G09G 3/3688* (2013.01); *G09G 2300/0871* (2013.01); *G09G 2310/08* (2013.01)

(58) Field of Classification Search
None
See application file for complete search history.

(56) References Cited

U.S. PATENT DOCUMENTS 8,374,010 B2 2/2013 Chang
2009/0195182 A1* 8/2009 Ezaki ..... H05B 33/0818 315/294

(Continued)

FOREIGN PATENT DOCUMENTS

CN 101169918 A 4/2008
CN 101185173 A 5/2008

(Continued)

*Primary Examiner* — Grant Sitta
*Assistant Examiner* — Amen Bogale
(74) *Attorney, Agent, or Firm* — Andrew C. Cheng

(57) ABSTRACT

The present disclosure discloses a timing sequences generation circuit and a LCD. The timing sequences generation circuit includes a PWM chip, N number of voltage input ends, N number of voltage output ends, N number of switch circuits, and N number of time delay circuits, and N is an integer larger than or equals to 2. The PWM chip includes N number of PWM output pins, and each of the PWM output pins respectively connects to one switch circuit and one time delay circuit to respectively control turn-on sequences of the N number of switch circuits. The N number of switch circuits respectively connects to the N number of voltage input ends and N number of voltage output ends.

6 Claims, 3 Drawing Sheets

(56) References Cited

U.S. PATENT DOCUMENTS

| | | | | |
|---|---|---|---|---|
| 2009/0219074 | A1 | 9/2009 | Kwon | |
| 2010/0211811 | A1* | 8/2010 | Zhou | G06F 1/26 713/330 |
| 2011/0169467 | A1* | 7/2011 | Pan | G06F 1/24 323/282 |

FOREIGN PATENT DOCUMENTS

| | | | |
|---|---|---|---|
| CN | 101242543 | A | 8/2008 |
| CN | 101589539 | A | 11/2009 |
| CN | 101902854 | A | 12/2010 |
| CN | 102216975 | A | 10/2011 |
| CN | 102640406 | A | 8/2012 |
| CN | 104635569 | A | 5/2015 |
| CN | 104680991 | A | 6/2015 |

* cited by examiner

TIMING SEQUENCES GENERATION CIRCUITS AND LIQUID CRYSTAL DEVICES

CROSS REFERENCE

This application claims the priority of Chinese Patent Application No. 201510427038.1, entitled "Timing sequences generation circuits and liquid crystal devices", filed on Jul. 20, 2015, the disclosure of which is incorporated herein by reference in its entirety.

FIELD OF THE INVENTION

The present invention relates to a display technology field, and more particularly to a timing sequences generation circuit and a liquid crystal device (LCD).

BACKGROUND OF THE INVENTION

Currently, a common display on the market is a liquid crystal display (LCD). During operations, each of the pixels of LCDs are turned on or off by a scanning driving circuit. The data driving circuit transmits the video signals to the pixels that are turned on so as to display images. The timing sequence of the scanning driving circuit and the data driving circuit are provided by a timing control circuit (TCON) in accordance with the input voltage. Usually, the timing of the input voltage of TCON is controlled by the PWM chip.

With respect to the conventional technology, in addition to that the TCON needs the input voltage of specific timing sequence, other circuits, such as the backlight driving circuit controlling the backlight brightness, also need timing sequence. The timing sequences needed by the circuits are different. Although the PWM includes a plurality of output pins for outputting multiple voltages, but one PWM chip is only capable of outputting the voltage of fixed timing sequence. Thus, the demand for the timing sequences for different circuits within the LCD cannot be satisfied.

SUMMARY OF THE INVENTION

The technical issue that the embodiment of the present disclosure solves is to provide a timing sequences generation circuit and a LCD, wherein one PWM chip may generate a plurality of timing sequence signals.

In one aspect, a timing sequences generation circuit includes: a PWM chip, N number of voltage input ends, N number of voltage output ends, N number of switch circuits, and N number of time delay circuits, and N is an integer larger than or equals to 2, wherein: the PWM chip includes N number of PWM output pins, and each of the PWM output pins respectively connects to one switch circuit and one time delay circuit to respectively control turn-on sequences of the N number of switch circuits; and the N number of switch circuits respectively connects to the N number of voltage input ends and N number of voltage output ends, when at least one of the switch circuits is turned on, a voltage of the voltage input end connected with the at least one of the switch circuits is transmitted to the voltage output end connected with the at least one of the switch circuit via the at least one switch circuit.

Wherein each of the N number of switch circuits includes a field effect transistor (FET), a gate of the FET connects to one time delay circuit and one OWM output pin of the PWM chip, and a source of the FET connects to one voltage input end, and a drain is one voltage output end.

Wherein each of the N number of time delay circuits includes one first capacitor, one end of the first capacitor connects to the gate of the FET, and the other end of the first capacitor is grounded.

Wherein with respect to the N number of switch circuits and N number of time delay circuits, each of the switch circuits cooperates with one time delay circuit to form a RC time delay circuit.

Wherein each of the N number of switch circuits includes a triode and a diode, and each of the N number of time delay circuits includes a first resistor, a second resistor, and a second capacitor, wherein with respect to each pairs of the switch circuit and the time delay circuit, a base of the triode connects to one end of the first resistor and one end of the second capacitor, a collector of the triode connects to an anode of the diode and one voltage input end, an emitter of the triode connects to one end of the second resistor and the emitter of the triode is one voltage output end; the other end of the second capacitor and the other end of the second resistor are grounded; and a cathode of the diode connects to the other end of the first resistor and one PWM output pin of the PWM chip.

Wherein the FET is a Metal-Oxide-Semiconductor (MOS) transistor.

Wherein the triode is a NPN-type triode.

In another aspect, a liquid crystal device (LCD) includes: a timing control circuit, a liquid crystal panel, a scanning driving circuit of the liquid crystal panel, a data driving circuit of the liquid crystal panel and the timing sequences generation circuit, the timing control circuit respectively connects to the timing sequences generation circuit, the scanning driving circuit and the data driving circuit of the liquid crystal panel, the scanning driving circuit and the data driving circuit respectively connect to the liquid crystal panel.

In view of the above, the timing sequences generation circuit includes a PWM chip, N number of voltage input ends, N number of voltage output ends, N number of switch circuits, and N number of time delay circuits. The turn-on sequences of the N number of switch circuits may be controlled by the PWM signals outputted by the N number of pins of the PWM chip and the delay effect of the N number of time delay circuit so as to obtain the N number of output voltages of different timing sequences according to the N number of input voltages. As such, the demand for the timing sequences for different circuits within the LCD cannot be satisfied. In view of the above, the PWM chip may generate a plurality of timing sequence signals to decrease the number of the PWM chips within the LCD. Not only the occupied space may be reduced, but also the cost of the circuit may be reduced.

BRIEF DESCRIPTION OF THE DRAWINGS

In order to more clearly illustrate the embodiments of the present disclosure or prior art, the following figures will be described in the embodiments are briefly introduced. It is obvious that the drawings are merely some embodiments of the present disclosure, those of ordinary skill in this field can obtain other figures according to these figures without paying the premise.

DETAILED DESCRIPTION OF PREFERRED EMBODIMENTS

Embodiments of the present disclosure are described in detail with the technical matters, structural features, achieved objects, and effects with reference to the accompanying drawings as follows. It is clear that the described embodiments are part of embodiments of the present disclosure, but not all embodiments. Based on the embodiments of the present disclosure, all other embodiments to those of ordinary skill in the premise of no creative efforts obtained, should be considered within the scope of protection of the present disclosure.

In the present disclosure, the timing sequences generation circuit and the LCD may be in a slight bright state before the LCD is turned on, and will be described in accordance with the embodiments hereinafter.

Figure 1:
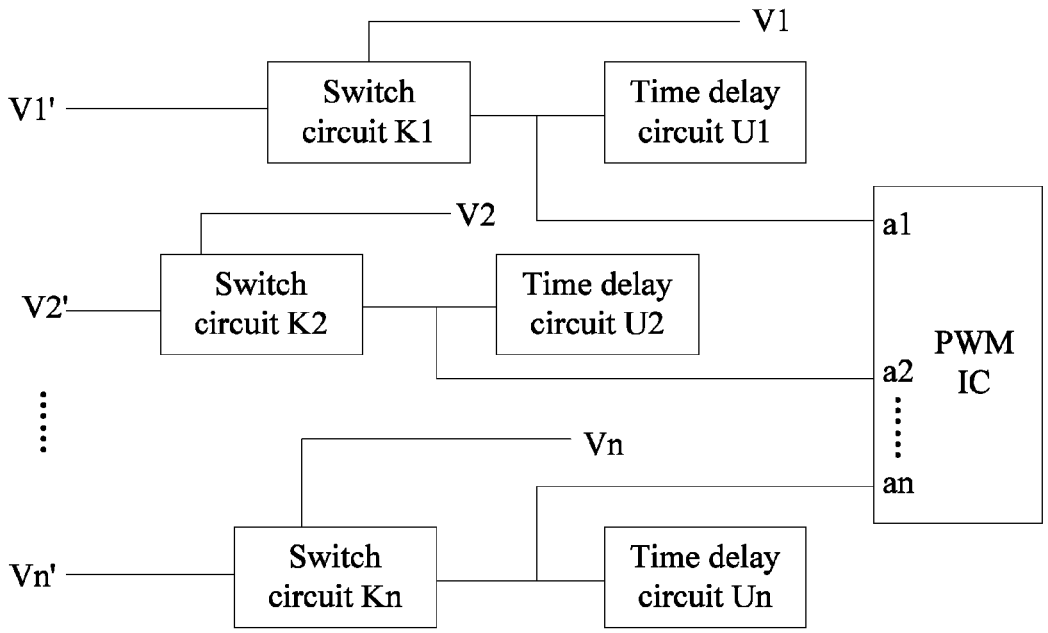
FIG. 1 is a schematic view of the timing sequences generation circuit in accordance with one embodiment.

FIG. 1 is a schematic view of the timing sequences generation circuit in accordance with one embodiment.

The timing sequences generation circuit may include a pulse-width modulation (PWM) chip, N number of voltage input ends, N number of voltage output ends, N number of switch circuits (K1), and N number of time delay circuits (U1-Un).

The PWM chip includes N number of PWM output pins (a1-an), and each of the PWM output pins respectively connects to one switch circuit and one time delay circuit so as to respectively control turn-on sequences of the N number of switch circuits.

The N number of switch circuits respectively connects to the N number of voltage input ends and N number of voltage output ends. When at least one of the switch circuits is turned on, the voltage of the voltage input end connected with the at least one of the switch circuits is transmitted to the voltage output end connected with the at least one of the switch circuit via the at least one switch circuit.

In the embodiment, N is an integer larger than or equals to 2, wherein the PWM chip may include N number of PWM output pins. Wherein each of the pins of the PWM output pins respectively connects to one switch circuit and one time delay circuit. Specifically, each of the PWM output pins output one control signals for controlling the connected switch circuit to turn on or off, and the time delay circuit connected with the switch circuit may delay the turn-on time or the turn-off time of the switch circuit. For instance, in one embodiment, when one of the PWM pin output the high level, the connected switch circuit may be turned on. However, the connected switch circuit may be turned on after a period of time due to the time delay circuit. In one embodiment, the parameters of the time delay circuit may be configured in advance to ensure the time period of each of the time delay circuits.

In one embodiment, the voltages of the N number of the voltage input ends of the timing sequences generation circuit may be V1 to Vn. The N number of the voltage output ends of the timing sequences generation circuit may respectively connect to the TCON, the liquid crystal panel, the driving circuit, and other circuits. When the switch circuit is turned on, the voltage of the N number of voltage input ends is transmitted to the N number of the voltage output ends via the turned on switch circuit to obtain N number of output voltages (V1' to Vn'). The timing sequences of the output voltages (V1' to Vn') of the N number of the voltage output ends may be controlled by the PW signals outputted by the N number of the PWM output pins and the N number of the time delay circuits, so as to provide the input signals of the timing sequences needed by other circuits.

Alternatively, the timing sequence of the output voltages (V1' to Vn') of the N number of voltage output ends may be the same or different, and may be obtained by configuring the parameters of the time delay circuit in advance in accordance with the connected circuit.

The timing sequences generation circuit of FIG. 1 includes a PWM chip, N number of voltage input ends, N number of voltage output ends, N number of switch circuits, and N number of time delay circuits. The turn-on sequences of the N number of switch circuits may be controlled by the PWM signals outputted by the N number of pins of the PWM chip and the delay effect of the N number of time delay circuit so as to obtain the N number of output voltages of different timing sequences according to the N number of input voltages. As such, the demand for the timing sequences for different circuits within the LCD cannot be satisfied. In view of the above, the PWM chip may generate a plurality of timing sequence signals to decrease the number of the PWM chips within the LCD. Not only the occupied space may be reduced, but also the cost of the circuit may be reduced.

Figure 2:
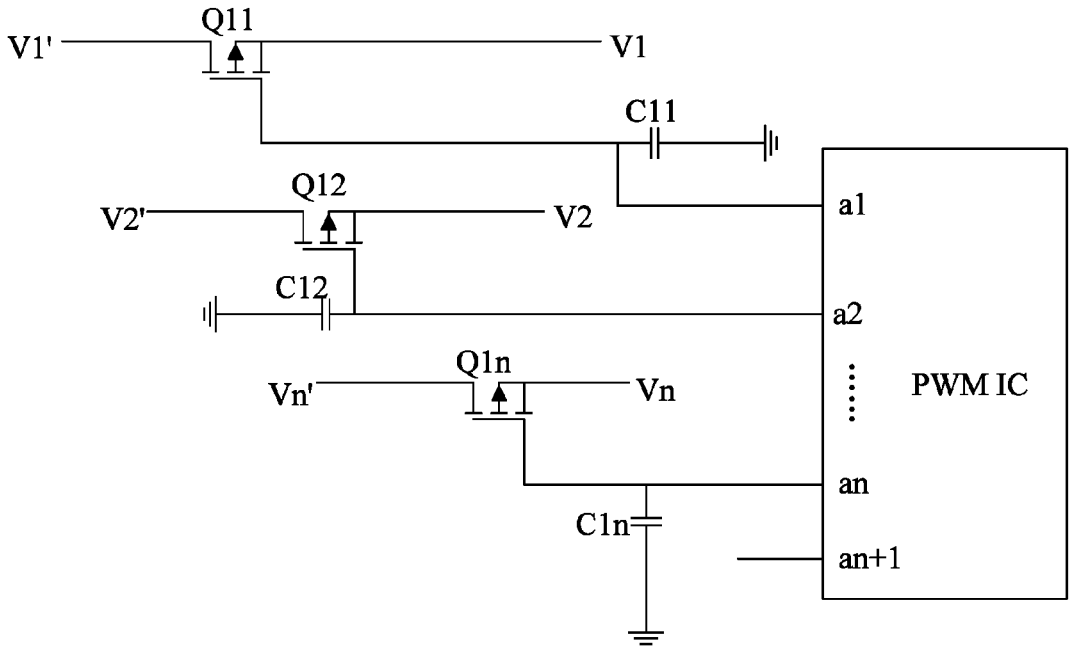
FIG. 2 is a circuit diagram of the timing sequences generation circuit in accordance with one embodiment.

FIG. 2 is a circuit diagram of the timing sequences generation circuit in accordance with one embodiment. The timing sequences generation circuit includes a PWM chip, N number of voltage input ends, N number of voltage output ends, N number of field effect transistors (FETs, Q11-Q1*n*), and N number of first capacitors (C11-C1*n*), wherein N is the integer larger than or equals to 2.

In the embodiment, each of the FETs may be one switch circuit. Each of the first capacitors may be one time delay circuit. A gate of each of the FETs connects to one end of the first capacitor and one PWM output pin of the PWM chip, a source of each of the FETs connects to one voltage input end, and a drain may be one voltage output end. One end of each of the first capacitor connects to the gate of one FET, and the other end of each of the first capacitor is grounded.

Specifically, N number of input voltages (V1-Vn) are inputted to the timing sequences generation circuit via the source of the N number of FETs. The voltages outputted from the N number of PWM output pins are respectively transmitted to the gate of the N number of FETs. With respect to each of the FETs, when the voltage of the gate reaches the turn-on voltage, the FET is turned on. The voltage inputted to the source is transmitted to the drain to obtain the corresponding output voltage. In one embodiment, when the FET is turned on, the turn-on resistance of the FET may consume a certain amount of electrical energy, and thus the output voltage is slightly smaller than the corresponding input voltage.

Specifically, the voltage at two ends of the capacitor cannot change suddenly. The gate of each of the FETs may connect to one first capacitor and one PWM output pin. Thus, when the voltage outputted by the PWM output pin changes, the gate voltage of the FET has not changed suddenly. Instead, the gate voltage of the FET changes gradually in accordance with the charge and discharge of the first capacitor. That is, the turn-on time or turn-off time of the FETs is not synchronous with the signals outputted by the PWM output pin. In one scenario, the timing sequences of the PWM signals outputted by the PWM output pins of the PWM chip are the same. By configuring the capacitance of the first capacitors connected with the PWM output pins in advance, the turn-on sequences of the FETs connected with the PWM output pins are different, such that the output voltages for different timing sequences may be obtained.

In one embodiment, the N-type FET may be Metal-Oxide-Semiconductor (MOS) transistor.

The timing sequences generation circuit of FIG. 2 includes a PWM chip, N number of voltage input ends, N number of voltage output ends, N number of FETs, and N number of first capacitors. The turn-on sequences of the N number of FETs may be controlled by the PWM signals outputted by the N number of pins of the PWM chip and the time delay of the N number of first capacitors, so as to obtain the N number of output voltage of different timing sequences in accordance with the N number of input voltages. As such, the demand for the timing sequences for different circuits within the LCD cannot be satisfied. In view of the above, the PWM chip may generate a plurality of timing sequence signals to decrease the number of the PWM chips within the LCD. Not only the occupied space may be reduced, but also the cost of the circuit may be reduced.

Figure 3:
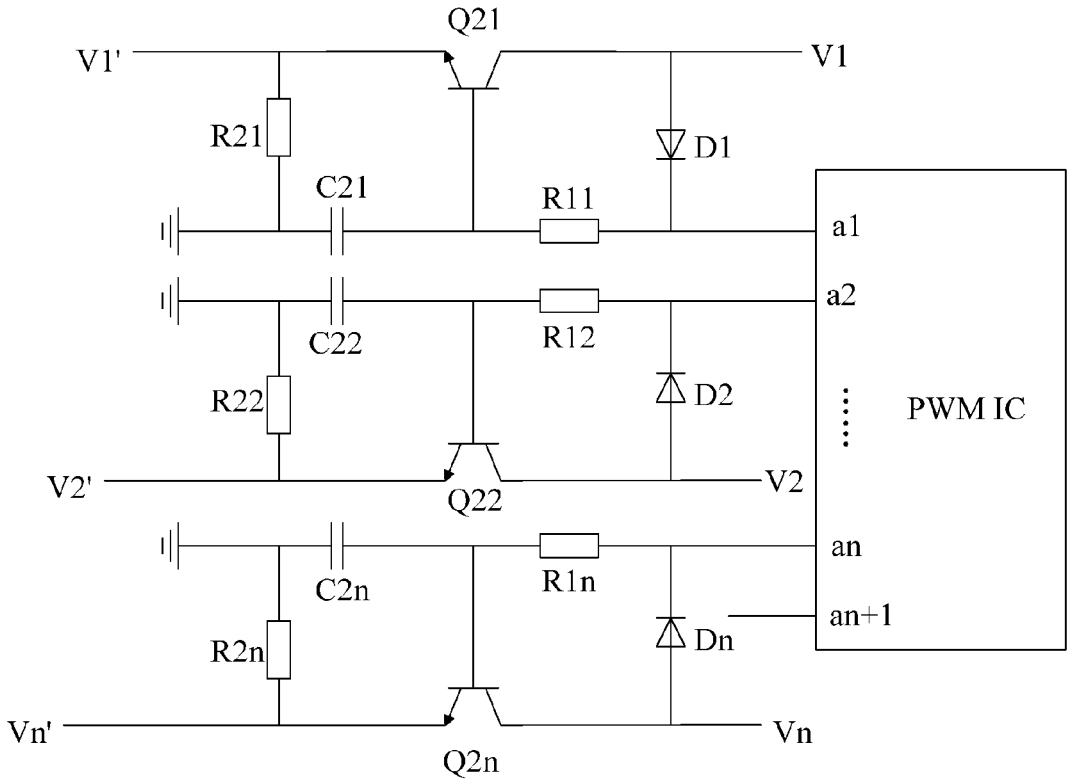
FIG. 3 is a circuit diagram of the timing sequences generation circuit in accordance with another embodiment.

FIG. 3 is a circuit diagram of the timing sequences generation circuit in accordance with another embodiment.

The timing sequences generation circuit includes a PWM chip, N number of voltage input ends, N number of voltage output ends, N number of triodes (Q21-Q3*n*), N number of diodes (D1-Dn), N number of first resistors (R11-R1*n*), N number of second resistor (R21-R2*n*), and N number of second capacitors (C21-C2*n*), wherein N is the integer larger than or equals to 2.

In the embodiment, each of the triodes may cooperate with one diode to operate as one switch circuit. Each of the first resistors may cooperate with one second capacitor and one second resistor to operate as one time delay circuit. Within a pair of one switch circuit and one time delay circuit, a base of the triode connects to one end of the first resistor and one end of the second capacitor, a collector of the triode connects to an anode of the diode and one voltage input end, an emitter of the triode connects to one end of the second resistor and the emitter of the triode is one voltage output end. The other end of the second capacitor and the other end of the second resistor are grounded. A cathode of the diode connects to the other end of the first resistor and one PWM output pin of the PWM chip.

Specifically, the N number of input voltages (V1-Vn) are respectively inputted to the timing sequences generation circuit via the collector of the N number of triodes. The voltage outputted by the N number of PWM output pins may be the voltage of the base of the N number of triodes for controlling the N number of triodes to be turned on or off. With respect to each of the triodes, when the voltage of the base reaches the turn-on voltage, the triode is turned on, and the voltage inputted from the collector is transmitted to the emitter to obtain the corresponding output voltage. With respect to each of the triodes, when the voltage of the gate reaches the turn-on voltage, the triode is turned on. The voltage inputted to the collector is transmitted to the emitter to obtain the corresponding output voltage. In one embodiment, when the triode is turned on, the turn-on resistance may consume a certain amount of electrical energy, and thus the output voltage is slightly smaller than the corresponding input voltage.

Specifically, the base of the triode connects with the second capacitor, and the voltage at two ends of the second capacitor cannot change suddenly. When the voltage outputted by the PWM output pin changes, the base voltage of the triode has changed gradually in accordance with the charge and discharge of the second capacitor. That is, the turn-on time or turn-off time of the triode is not synchronous with the signals outputted by the PWM output pin.

In one scenario, the timing sequences of the PWM signals outputted by the PWM output pins of the PWM chip are the same. By configuring the capacitance of the second capacitors connected with the PWM output pins in advance, the turn-on sequences of the FETs connected with the PWM output pins are different, such that the output voltages for different timing sequences may be obtained.

Specifically, the first resistor and the second resistor may provide the voltage-division effect, and the diode may protect the triode.

In one embodiment, the triode may be a NPN-type triode.

The timing sequences generation circuit of FIG. 3 includes a PWM chip, N number of voltage input ends, N number of voltage output ends, and N number of RC time delay circuits. The number of output voltage of different timing sequences may be obtained in accordance with the N number of input voltages by the PWM signals outputted from the N number of pins of the PWM chip and the time delay effect of the N number of RC time delay circuits. As such, the demand for the timing sequences for different circuits within the LCD cannot be satisfied. In view of the above, the PWM chip may generate a plurality of timing sequence signals to decrease the number of the PWM chips within the LCD. Not only the occupied space may be reduced, but also the cost of the circuit may be reduced.

Figure 4:
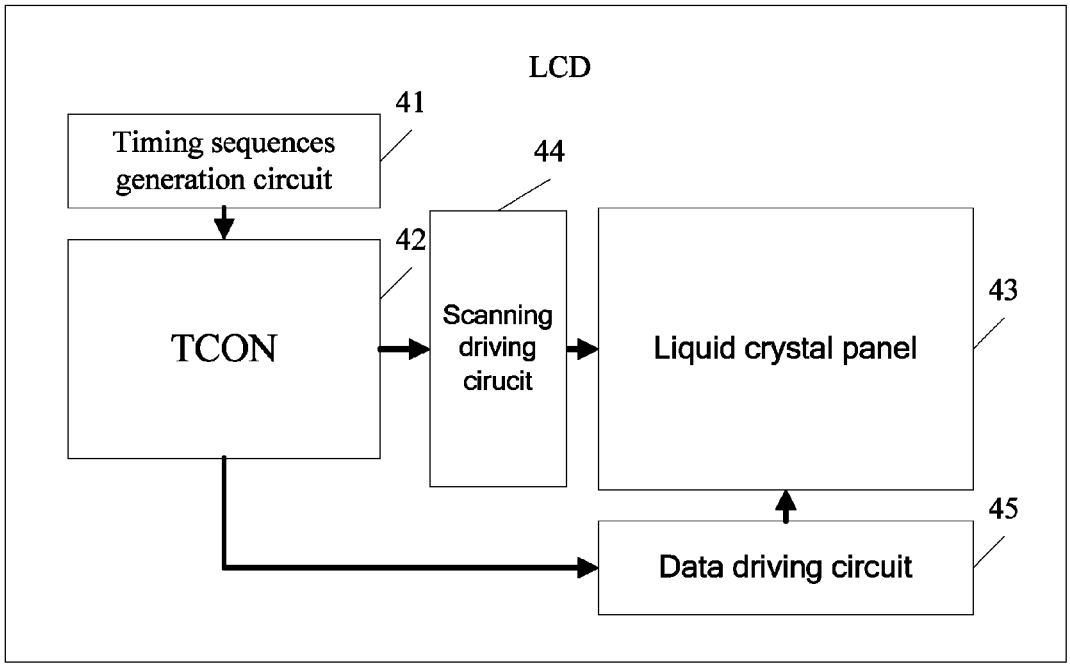
FIG. 4 is a schematic view of the LCD in accordance with one embodiment.

FIG. 4 is a schematic view of the LCD in accordance with one embodiment. The LCD includes the timing sequences generation circuit 41 as described in any of FIGS. 1-3. The LCD also includes a TCON 42, a liquid crystal panel 43, a scanning driving circuit 44 of the liquid crystal panel, and the data driving circuit 45 of the liquid crystal panel. Wherein the TCON 42 respectively connects to the timing sequences generation circuit 41, the scanning driving circuit 44, and the data driving circuit 45. The scanning driving circuit 44 and the data driving circuit 45 respectively connects to the liquid crystal panel 43.

In the embodiment, the TCON 42 is the core circuit of the liquid crystal panel 43. The TCON 42 may control the turn-on sequences of the scanning driving circuit 44, convert the inputted video signals (LVDS signals) into the format adopted by the data driving circuit, such as mini-LVDS signals or RSDS signals, and transmit the signals to the data driving circuit 45. Further, the data driving circuit 45 is turned on in accordance with the timing sequence, such that the timing sequences needed by the scanning driving circuit 44 and the data driving circuit 45 of the liquid crystal panel 43 are generated.

In one embodiment, the timing sequences generation circuit 41 may generate a plurality of timing sequences operating as the timing sequences of the TCON. In addition, the timing sequences generation circuit 41 may provide the timing sequences to other circuits, such as backlight driving circuits, within the liquid crystal panel 43 or the LCD.

In view of the above, the LCD may generate a plurality of timing sequences via one timing sequences generation circuit so as to provide the transmission signals for TCON and other circuits within the LCD. In this way, the number of the timing generation circuits within the LCD is decreased. Not only the occupied space may be reduced, but also the cost of the circuit may be reduced.

Above are embodiments of the present disclosure, which does not limit the scope of the present disclosure. Any modifications, equivalent replacements or improvements within the spirit and principles of the embodiment described above should be covered by the protected scope of the disclosure.

What is claimed is:

1. A timing sequences generation circuit, comprising:

a PWM chip, N number of voltage input ends, N number of voltage output ends, N number of switch circuits, and N number of time delay circuits, and N is an integer larger than or equals to 2, wherein:

the PWM chip comprises N number of PWM output pins, and each of the PWM output pins respectively connects to one switch circuit and one time delay circuit to respectively control turn-on sequences of the N number of switch circuits; and the N number of switch circuits respectively connects to the N number of voltage input ends and N number of voltage output ends, when at least one of the switch circuits is turned on, a voltage of the voltage input end connected with the at least one of the switch circuits is transmitted to the voltage output end connected with the at least one of the switch circuit via the at least one switch circuit; and wherein each of the N number of switch circuits comprises a triode and a diode, and each of the N number of time delay circuits comprises a first resistor, a second resistor, and a second capacitor, wherein with respect to each pairs of the switch circuit and the time delay circuit, a base of the triode connects to one end of the first resistor and one end of the second capacitor, a collector of the triode connects to an anode of the diode and one voltage input end, an emitter of the triode connects to one end of the second resistor and the emitter of the triode is one voltage output end;

the other end of the second capacitor and the other end of the second resistor are grounded; and a cathode of the diode connects to the other end of the first resistor and one PWM output pin of the PWM chip.

2. The timing sequences generation circuit as claimed in claim 1, wherein with respect to the N number of switch circuits and N number of time delay circuits, each of the switch circuits cooperates with one time delay circuit to form a RC time delay circuit.

3. The timing sequences generation circuit as claimed in claim 1, wherein the triode is a NPN-type triode.

4. A liquid crystal device (LCD), comprising:

a timing control circuit, a liquid crystal panel, a scanning driving circuit of the liquid crystal panel, a data driving circuit of the liquid crystal panel and a timing sequences generation circuit, the timing control circuit respectively connects to the timing sequences generation circuit, the scanning driving circuit and the data driving circuit of the liquid crystal panel, the scanning driving circuit and the data driving circuit respectively connect to the liquid crystal panel;

the timing sequences generation circuit comprises a PWM chip, N number of voltage input ends, N number of voltage output ends, N number of switch circuits, and N number of time delay circuits, and N is an integer larger than or equals to 2, wherein:

the PWM chip comprises N number of PWM output pins, and each of the PWM output pins respectively connects to one switch circuit and one time delay circuit to respectively control turn-on sequences of the N number of switch circuits; and the N number of switch circuits respectively connects to the N number of voltage input ends and N number of voltage output ends, when at least one of the switch circuits is turned on, a voltage of the voltage input end connected with the at least one of the switch circuits is transmitted to the voltage output end connected with the at least one of the switch circuit via the at least one switch circuit t; and wherein each of the N number of switch circuits comprises a triode and a diode, and each of the N number of time delay circuits comprises a first resistor, a second resistor, and a second capacitor, wherein with respect to each pairs of the switch circuit and the time delay circuit, a base of the triode connects to one end of the first resistor and one end of the second capacitor, a collector of the triode connects to an anode of the diode and one voltage input end, an emitter of the triode connects to one end of the second resistor and the emitter of the triode is one voltage output end;

the other end of the second capacitor and the other end of the second resistor are grounded; and a cathode of the diode connects to the other end of the first resistor and one PWM output pin of the PWM chip.

5. The LCD as claimed in claim 4, wherein with respect to the N number of switch circuits and N number of time delay circuits, each of the switch circuits cooperates with one time delay circuit to form a RC time delay circuit.

6. The LCD as claimed in claim 4, wherein the triode is a NPN-type triode.

* * * * *